US010476191B2

(12) United States Patent
Venaleck

(10) Patent No.: US 10,476,191 B2
(45) Date of Patent: Nov. 12, 2019

(54) FORKED ELECTRICAL CONTACT PAIR WITH ELASTIC TAIL

(71) Applicant: Ohio Associated Enterprises, LLC, Painesville, OH (US)

(72) Inventor: John T. Venaleck, Painesville, OH (US)

(73) Assignee: Ohio Associated Enterprises, LLC, Painesville, OH (US)

( * ) Notice: Subject to any disclaimer, the term of this patent is extended or adjusted under 35 U.S.C. 154(b) by 0 days.

(21) Appl. No.: 15/907,657

(22) Filed: Feb. 28, 2018

(65) Prior Publication Data

US 2019/0267737 A1 Aug. 29, 2019

(51) Int. Cl.

| | |
|---|---|
| ***H01R 13/11*** | (2006.01) |
| ***H01R 12/58*** | (2011.01) |
| ***H01R 13/05*** | (2006.01) |

(52) U.S. Cl.

CPC ..... *H01R 13/112* (2013.01); *H01R 12/585* (2013.01); *H01R 13/05* (2013.01)

(58) Field of Classification Search

CPC ..... H01R 13/26; H01R 13/28; H01R 24/84; H01R 13/112; H01R 13/05; H01R 12/585; H01R 12/51; H01R 12/52; H01R 12/716

USPC ..... 439/889, 891, 65, 69, 74

See application file for complete search history.

(56) References Cited

U.S. PATENT DOCUMENTS

| | | | | |
|---|---|---|---|---|
| 3,400,358 | A * | 9/1968 | Byrnes | H01R 13/33 29/461 |
| 3,960,434 | A * | 6/1976 | Soes | H01R 13/02 439/660 |
| 4,636,026 | A | 1/1987 | Cooney et al. | |
| 4,889,499 | A * | 12/1989 | Sochor | H01R 13/193 439/268 |
| 5,004,426 | A * | 4/1991 | Barnett | H01R 12/585 439/82 |
| 5,221,209 | A | 6/1993 | D'Amico | |
| 5,224,866 | A * | 7/1993 | Nakamura | H01R 12/716 439/346 |
| 6,241,560 | B1 * | 6/2001 | Furusawa | H01R 13/2471 439/700 |
| 6,287,144 | B1 | 9/2001 | Baffert | |
| 6,517,372 | B1 * | 2/2003 | Jones | H01R 4/26 439/159 |
| 6,616,459 | B2 * | 9/2003 | Norris | H01R 12/585 439/751 |

(Continued)

*Primary Examiner* — Travis S Chambers

(74) *Attorney, Agent, or Firm* — Renner, Otto, Boisselle & Sklar, LLP

(57) ABSTRACT

An electrical contact pair includes a laminated pair of male forks and female forks that are stamped from sheet metal stock and are molded into a dielectric housing. The male fork tines have sloped outer surfaces sloping toward a centerline of the contact pair in a direction along the male fork tines away from a base of the male fork. The female fork tines have sloped inner surfaces sloping away from the centerline of the contact pair in a direction along the female fork tines away from a base of the female fork. The contacts may include split tails with parts from different laminates that bow outward and resiliently deform to engage walls of a hole into which the tail is inserted. Advantages include low insertion forces, a press-fit board attach from the split tail, multiple electrical paths for low resistance, and a low cost of manufacture.

21 Claims, 5 Drawing Sheets

(56) References Cited

U.S. PATENT DOCUMENTS

| | | | | |
|---|---|---|---|---|
| 6,861,862 | B1 | 3/2005 | Tate | |
| 6,974,329 | B2 * | 12/2005 | Henneberg | H01R 12/585 439/59 |
| 7,256,593 | B2 | 8/2007 | Treibergs | |
| 7,479,794 | B2 | 1/2009 | Chartarifsky | |
| 7,682,192 | B2 * | 3/2010 | Sawdy | H01R 13/514 439/607.05 |
| 8,033,872 | B2 | 10/2011 | Yang et al. | |
| 8,047,875 | B2 * | 11/2011 | Yamakami | H01R 13/6471 439/660 |
| 8,251,758 | B2 * | 8/2012 | Yoshida | H01R 13/28 439/290 |
| 8,262,419 | B2 | 9/2012 | Chen et al. | |
| 8,373,430 | B1 | 2/2013 | Sochor | |
| 8,460,010 | B2 | 6/2013 | Kimura et al. | |
| 8,523,579 | B2 * | 9/2013 | Johnston | H01R 13/2421 439/66 |
| 8,573,983 | B2 | 11/2013 | Zieder | |
| 8,715,015 | B2 | 5/2014 | Hwang | |
| 9,190,749 | B2 | 11/2015 | Chen et al. | |
| 9,853,385 | B1 | 12/2017 | Crofoot et al. | |
| 2004/0038586 | A1 | 2/2004 | Hall et al. | |
| 2012/0238136 | A1 | 9/2012 | Hwang | |

* cited by examiner

FORKED ELECTRICAL CONTACT PAIR WITH ELASTIC TAIL

FIELD OF THE INVENTION

The invention is in the field of electrical contacts.

DESCRIPTION OF THE RELATED ART

In the field of electrical connectors that are specifically designed to transmit large electrical currents, the typical contact pair consists of a male pin and a female receiver with provision to adjust electrically to the male pin diameter. The female receiver usually has multiple arms formed around the receiving diameter to give multiple current paths for low resistance. These multiple paths usually engage the male pin simultaneously and results in a reasonably large insertion force. The typical method of manufacturing is by turning round stock on a screw machine.

SUMMARY OF THE INVENTION

According to an aspect of the invention, a stamped sheet metal contact pair includes: a male fork contact that includes a male fork base, and a pair of male fork tines emerging from the male fork base; and a female fork contact that includes a female fork base, and a pair of female fork tines emerging from the female fork base. The male fork tines have sloped outer surfaces sloping toward a centerline of the contact pair in a direction along the male fork tines away from the male fork base. The female fork tines have sloped inner surfaces sloping away from the centerline of the contact pair in a direction along the female fork tines away from the female fork base.

According to an embodiment of any paragraph(s) of this summary, the sloped inner surfaces and the sloped outer surfaces have the same slope.

According to an embodiment of any paragraph(s) of this summary, the sloped inner surfaces and the sloped outer surfaces have slopes that are between 5 and 15 degrees.

According to an embodiment of any paragraph(s) of this summary, the male fork tines have respective outward protrusions, with curved outer surfaces, that protrude outward of the sloped outward surfaces, such that the outward protrusions make contact with the sloped inner surfaces of the female fork tines during engagement of the contacts.

According to an embodiment of any paragraph(s) of this summary, the outward protrusions are located at distal ends of the male fork tines, further from the male fork base than the sloped outer surfaces.

According to an embodiment of any paragraph(s) of this summary, the female fork tines define inward-facing receptacle recesses that receive the outward protrusions when the contacts are fully engaged.

According to an embodiment of any paragraph(s) of this summary, the inward-facing receptacle recesses have curved surfaces.

According to an embodiment of any paragraph(s) of this summary, the curved surfaces of the inward-facing receptacle recesses have a radius of curvature that is smaller than a radius of curvature of the outward protrusions, such that when the contacts are engaged each of the outward protrusions makes contact at multiple contact points with a corresponding of the inward-facing receptacle recesses.

According to an embodiment of any paragraph(s) of this summary, the female fork tines have respective inward protrusions, with curved inner surfaces, that protrude inward of the sloped inward surfaces, such that the inward protrusions make contact with the sloped outer surfaces of the male fork tines during engagement of the contacts.

According to an embodiment of any paragraph(s) of this summary, the inward protrusions are located at distal ends of the female fork tines, further from the female fork base than the sloped inner surfaces.

According to an embodiment of any paragraph(s) of this summary, the male fork tines define outward-facing receptacle recesses that receive the inward protrusions when the contacts are fully engaged.

According to an embodiment of any paragraph(s) of this summary, the outward-facing receptacle recesses have curved surfaces.

According to an embodiment of any paragraph(s) of this summary, the curved surfaces of the outward-facing receptacle recesses have a radius of curvature that is smaller than a radius of curvature of the inward protrusions, such that when the contacts are engaged each of the inward protrusions makes contact at multiple contact points with a corresponding of the outward-facing receptacle recesses.

According to an embodiment of any paragraph(s) of this summary, the contacts are each symmetric about a plane of symmetry running through the centerline, between the male fork tines and the female fork tines.

According to an embodiment of any paragraph(s) of this summary, the contacts further include: an additional male fork contact stacked with the male fork contact to form a stacked male fork contact, with the male fork contact and the additional male contact having an identical configuration of male fork tines; and an additional female fork contact stacked with the female fork contact to form a stacked female fork contact, with the female fork contact and the additional female contact having an identical configuration of female fork tines.

According to an embodiment of any paragraph(s) of this summary, one of the stacked contacts includes a tail which defines an eye between tail portions of the contacts of the one of the stacked contacts.

According to an embodiment of any paragraph(s) of this summary, the tail portions are on an opposite side of the one of the stacked contacts from the tines of the one of the stacked contacts.

According to an embodiment of any paragraph(s) of this summary, the eye is defined by at least one of the tail portions being bowed away from the other of the tail portions.

According to an embodiment of any paragraph(s) of this summary, both of the tail portions bow away from each other to define the eye.

According to an embodiment of any paragraph(s) of this summary, the contacts are stamped sheet metal contacts.

According to another aspect of the invention, an electrical contact includes: overlapping stacked fork laminates, wherein each of the fork laminates includes a base, a pair of fork tines extending from the base, and a tail portion extending from the base in an opposite direction from the tines. The tail portions are bowed away from each other, thereby defining an eye between the tail portions, with the tail portions configured to elastically engage a hole into which they are inserted by compressing into the eye.

According to an embodiment of any paragraph(s) of this summary, the laminates are stamped sheet metal laminates.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

Figure 2:
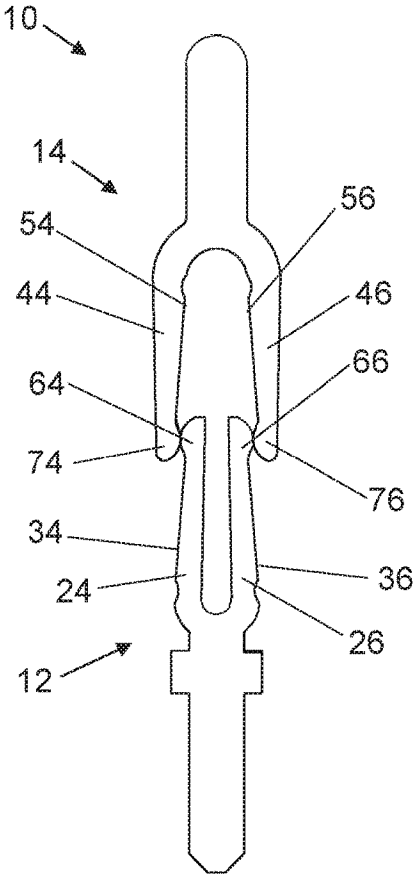
FIG. 2 is a plan view of the electrical contact pair of FIG. 1, at a second (further) stage of the engagement.

An electrical contact pair includes a laminated pair of male forks and female forks that are stamped from sheet metal stock and are molded into a dielectric housing. The male fork tines have sloped outer surfaces sloping toward a centerline of the contact pair in a direction along the male fork tines away from a base of the male fork. The female fork tines have sloped inner surfaces sloping away from the centerline of the contact pair in a direction along the female fork tines away from a base of the female fork. The contacts may include split tails with parts from different laminates that bow outward and resiliently deform to engage walls of a hole into which the tail is inserted. Advantages include low insertion forces, a press-fit board attach from the split tail, multiple electrical paths for low resistance, and a low cost of manufacture.

FIGS. 1-4 show an electrical contact pair 10 that includes a male fork (male contact) 12 that engages a female fork (female contact) 14, at various points during an engagement process. The forks 12 and 14 may be parts of laminated forks, each with a pair of the forks 12 and 14 stacked upon each other.

The male fork 12 includes a male fork base 22, and a pair of male fork tines 24 and 26 emerging from the male fork base 22. The male fork tines 24 and 26 have sloped outer surfaces 34 and 36 sloping toward a centerline 40 of the contact pair in a direction along the male fork tines 24 and 26 away from the male fork base 22.

The female fork 14 that includes a female fork base 42, and a pair of female fork tines 44 and 46 emerging from the female fork base 42. The female fork tines 44 and 46 have sloped inner surfaces 54 and 56 sloping away from the centerline 40 in a direction along the female fork tines 44 and 46 away from the female fork base 42.

The sloped inner surfaces 54 and 56, and the sloped outer surfaces 34 and 36 may have slopes that are between 5 and 15 degrees.

The male fork tines 24 and 26 have respective outward protrusions 64 and 66, with curved outer surfaces, that protrude outward of the sloped outward surfaces 34 and 36, such that the outward protrusions 64 and 66 make contact with the sloped inner surfaces 54 and 56 of the female fork tines 44 and 46 during engagement of the contacts 12 and 14. The outward protrusions 64 and 66 are located at distal ends of the male fork tines 24 and 26, further from the male fork base 22 than the sloped outer surfaces 34 and 36.

The female fork tines 44 and 46 have respective inward protrusions 74 and 76, with curved inner surfaces, that protrude inward of the sloped inward surfaces 54 and 56, such that the inward protrusions 74 and 76 make contact with the sloped outer surfaces 34 and 36 of the male fork tines 24 and 26 during engagement of the contacts 12 and 14. The inward protrusions 74 and 76 are located at distal ends of the female fork tines 44 and 46, further from the female fork base 42 than the sloped inner surfaces 54 and 56.

At proximal ends of the male fork tines 24 and 26, close to the base 22, the tines 24 and 26 define outward-facing receptacle recesses 84 and 86 that receive the inward protrusions 74 and 76 when the contacts 12 and 14 are fully engaged. The outward-facing receptacle recesses 84 and 86 have curved surfaces. The curved surfaces of the outward-facing receptacle recesses 84 and 86 may have a radius of curvature that is smaller than a radius of curvature of the inward protrusions 74 and 76, such that when the contacts 12 and 14 are engaged each of the inward protrusions 74 and 76 makes contact at multiple contact points with a corresponding of the outward-facing receptacle recesses 84 and 86.

Similarly, the female fork tines 44 and 46 define at their proximal ends inward-facing receptacle recesses 94 and 96 that receive the outward protrusions 64 and 66 when the contacts 12 and 14 are fully engaged. These inward-facing receptacle recesses 94 and 96 have curved surfaces, which may have a radius of curvature that is smaller than a radius of curvature of the outward protrusions 64 and 66, such that when the contacts 12 and 14 are engaged each of the outward protrusions 64 and 66 makes contact at multiple contact points with a corresponding of the inward-facing receptacle recesses 94 and 96.

The contacts 12 and 14 are each symmetric about a plane of symmetry running through the centerline 40, between both the male fork tines 24 and 26, and the female fork tines 44 and 46. This symmetry has the advantage of providing balanced forces on the contacts 12 and 14.

Figure 1:
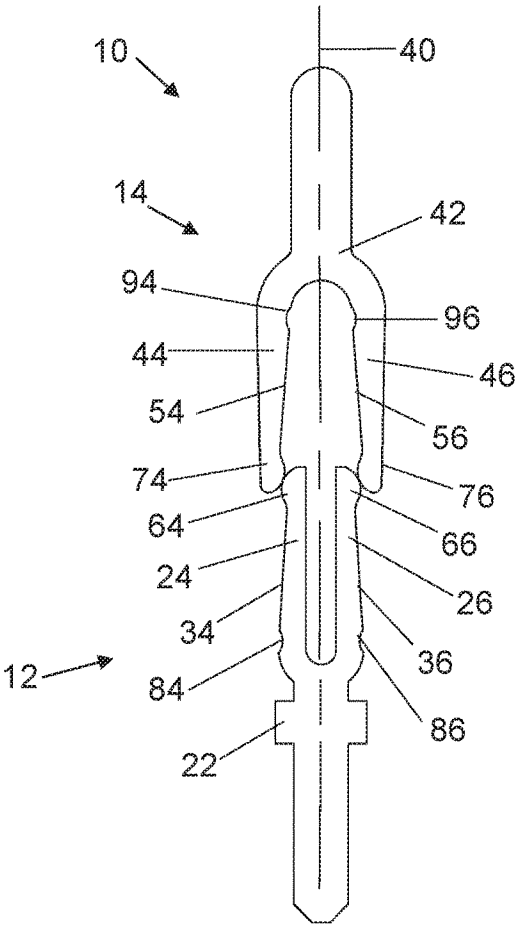
FIG. 1 is a plan view of an electrical contact pair according to an embodiment of the invention, in an initial stage of engagement.

FIG. 1 shows the contacts 12 and 14 at the beginning of the engagement, with the protrusions 64 and 66 in contact with the protrusions 74 and 76, and with only a slight interference between the tines of the forked contacts 12 and 14. The curved surfaces of the protrusions 64, 66, 74, and 76 may act as engagement ramps, encouraging separation of the tines of each of the forks 12 and 14 as the contacts are brought together. The shared deflection of the male and female tines accounts for the reduction of insertion forces to half of the conventional design where the male contact does not contribute and the female contact has double deflection.

FIG. 2 shows the forks 12 and 14 engaged to the point that the protrusions 64 and 66 have come close to contact with the inward surfaces 54 and 56, and the protrusions 74 and 76 have come close to contact with the outward surfaces 34 and 36. The tines 24 and 26 of the male fork 12 have been displaced inward, and the tines 44 and 46 of the female fork 14 have been displaced outward. The tines 24 and 26 may be beams having the same stiffness as that of the tines 44 and 46. This advantageously results in the deflections of the tines 24 and 26 being the same of the tines 44 and 46, with the forks 12 and 14 sharing the load equally.

Figure 3:
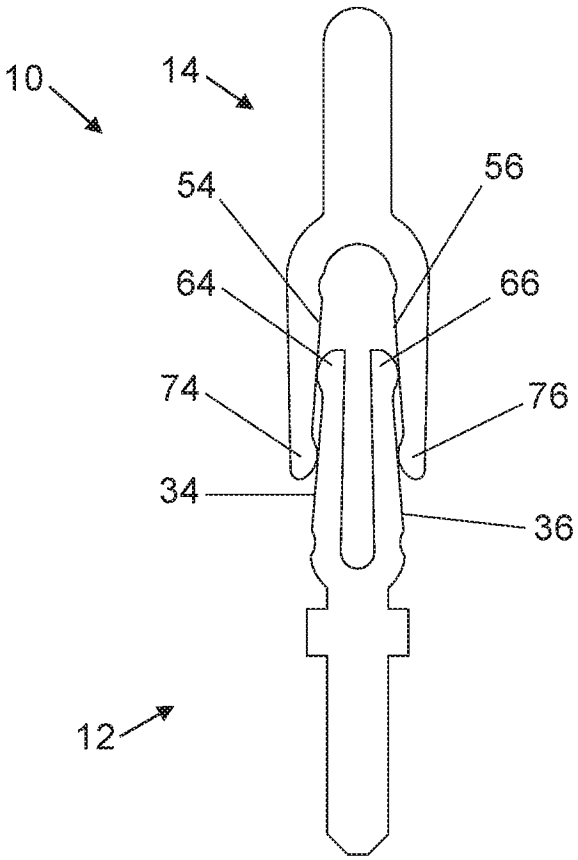
FIG. 3 is a plan view of the electrical contact pair of FIG. 1, at a third stage of the engagement.

FIG. 3 shows the engagement progressing, with the protrusions 64, 66, 74, and 76 about halfway along their corresponding surfaces 34, 36, 54, and 56. The gentle slope of the surfaces 34, 36, 54, and 56 gives a large mechanical advantage. As such, most of the force resisting engagement is frictional forces of the protrusions 64, 66, 74, and 76 sliding along the surfaces 34, 36, 54, and 56. At this stage in the engagement process there are four points of contact between the forks 12 and 14, one for each contact between a protrusion and a sloped surface.

Figure 4:
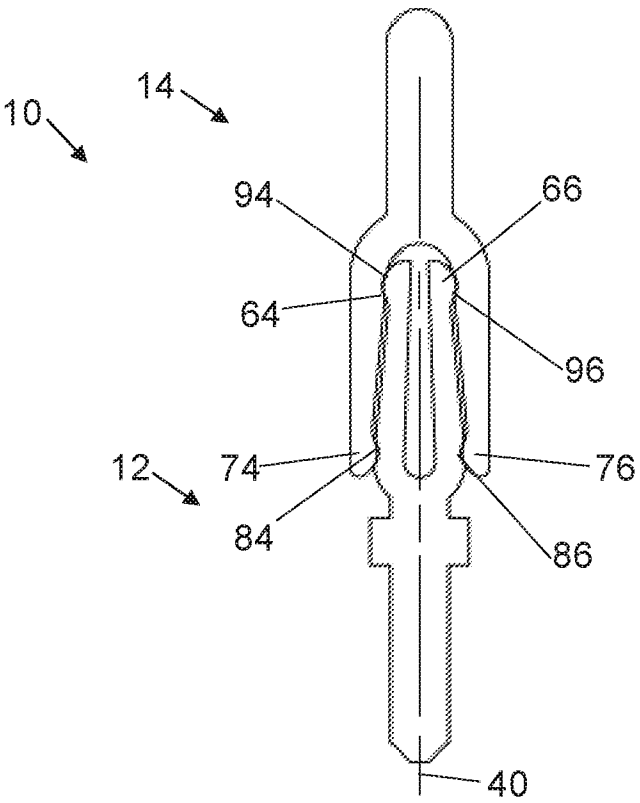
FIG. 4 is a plan view of the electrical contact pair of FIG. 1, with the contacts fully engaged.
Figure 5:
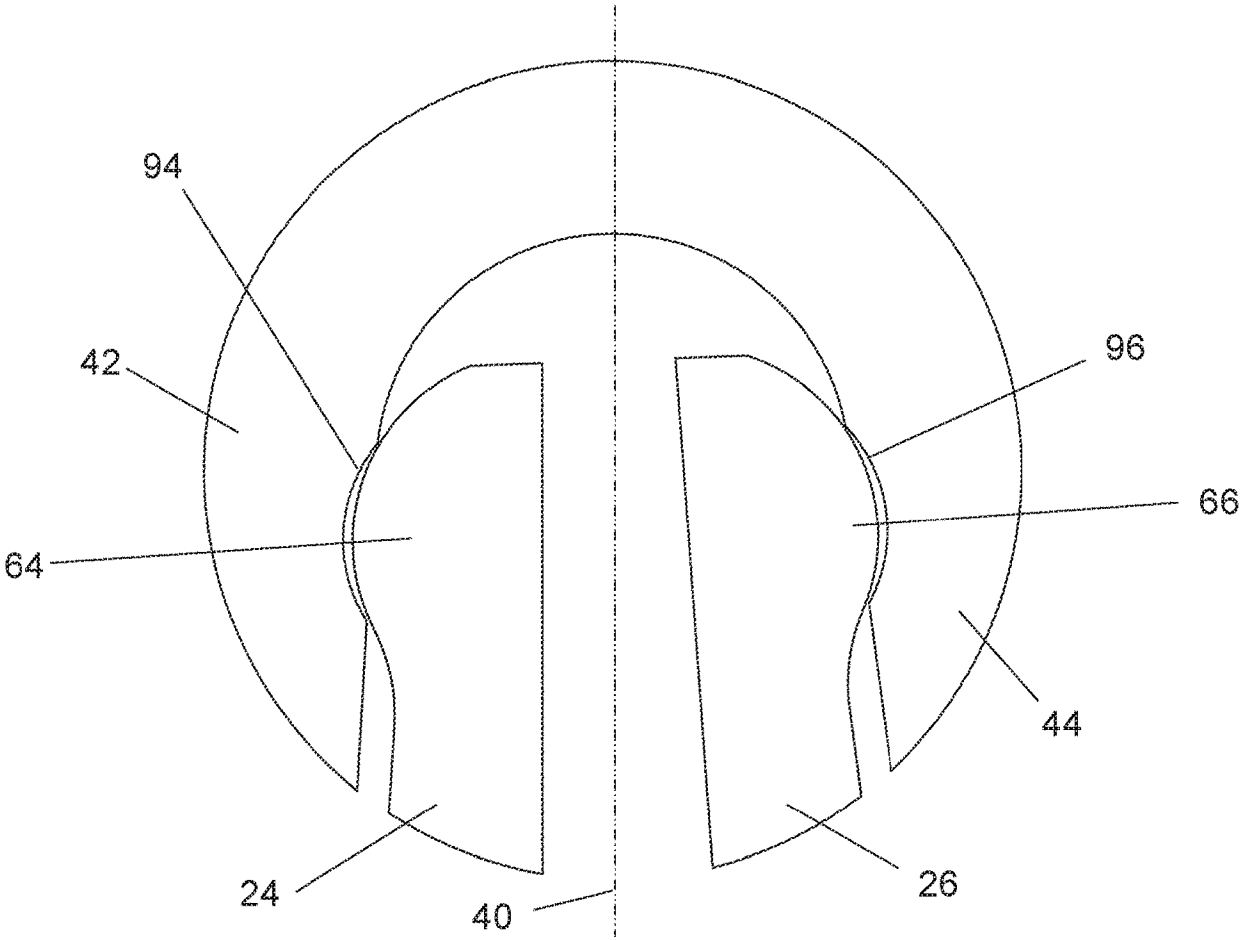
FIG. 5 is a magnified view of a portion of the fully-engaged contacts of FIG. 4.

FIGS. 4 and 5 show the contacts 12 and 14 fully engaged. The protrusions 64 and 66 engage the recesses 94 and 96, and the protrusions 74 and 76 engage the recesses 84 and 86. As best seen in FIG. 5, the male fork outward protrusions 64 and 66 have a radius that is larger than the radius of the corresponding female fork recesses 94 and 96. This results in each of the protrusions 64 and 66 contacting the corresponding of the recesses 94 and 96 at two points, for a total of four contact points. Similarly there are four contact points between the protrusions 74 and 76 and the recesses 84 and 86. There are therefore two distinct current paths, one on each side of the centerline 40, each with four contact points to carry the current, two at each end of the tines.

The fork contacts 12 and 14 are single laminates that may be stamped from sheet metal, such as copper or gold-plated copper. Laminates may be stacked, so as to produce multi-laminate contacts, as described further below. For stacked laminates the number of contact points and the current capacity is multiple by the number of stacked laminates.

The contacts 12 and 14 are both elastic members, with an elastic female member and an elastic male member. Because the method of manufacture is by stamping the shape from sheet metal, the cost of manufacturing is much lower than the typical method of producing cylindrical parts on a screw machine lathe. Since both members deflect equally upon contact engagement, the initial insertion force is half the magnitude of an equivalent single elastic element configuration. The final deflection of the contact pair happens over a relatively long path along a shallow angle ramp and the final resting position gives equivalent contact normal forces without excessive insertion forces.

Figure 6:
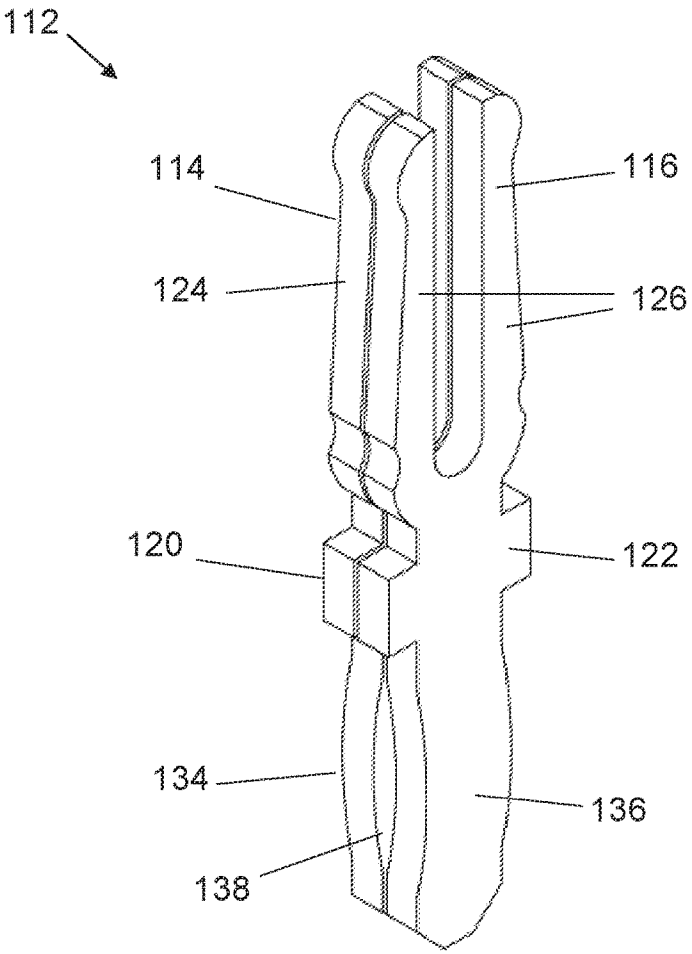
FIG. 6 is an oblique view of a male electrical contact in accordance with another embodiment of the invention.

FIG. 6 shows a male contact 112 with back-to-back male laminate forks 114 and 116. The forks 114 and 116 have bases 120 and 122, and tines 124 and 126, with many of the features of the male fork 12 (FIG. 1), the details of which are not repeated here. The forks 114 and 116 have tail portions 134 and 136 that extend in from the bases 120 and 122, in the opposite direction from that of the extension of the tines 124 and 126. The tail portions 134 and 136 are bowed out from the plane of the rest of the forks 114 and 116. The forks 114 and 116 are assembled back to back, with the tail portions 134 and 136 bowing away from each other. Together the tail portions 134 and 136 define an eye 138, a space between the bowed tail portions 134 and 136. The eye 138 allows for resilient deformation of one or both of the tail portions 134 and 136 as the tail portions 134 and 136 are inserted into a hole, such as a via on a circuit board. This allows the tail portions 134 and 136 to resiliently engage the hole, to mechanically retain the male contact 112 in such a hole, and to electrically couple the forks 114 and 116 to conductive material on the wall of the hole. This bends or bowing of the tail portions 134 and 136, and the resulting eye 138, allows the tail to elastically engage the circuit board via with interference, causing four interference contact points in the round via hole. Since this interference causes a relatively large radial force, the four contact areas of engagement will carry substantial current.

Figure 7:
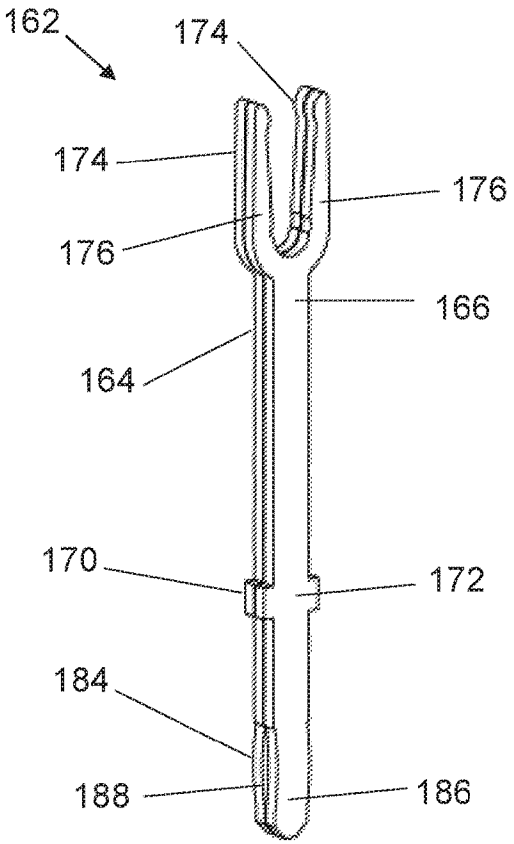
FIG. 7 is an oblique view of a female electrical contact in accordance with still another embodiment of the invention.

FIG. 7 shows a female contact 162 with back-to-back female laminate forks 164 and 166. The forks 164 and 166 have bases 170 and 172, and tines 174 and 176 with many of the features of the female fork 14 (FIG. 1). The forks 164 and 166 have tail portions 184 and 186 that extend in from the bases 170 and 172. The tail portions 184 and 186 are bowed out, and together an eye 188, a space between the bowed tail portions 184 and 186, in a manner similar to the tail portions 134 and 136 (FIG. 7) of the male contact 112 (FIG. 7), and have a similar function to the tail portions 134 and 136.

The tail portions may be other than described above with regard to FIGS. 6 and 7. For example it may be possible to have only one of the tail portions bow or otherwise deviate out of the plane of the forks, or for one or both of the forks to have different shapes from that of the illustrated embodiment. However the illustrated embodiment has the advantage of having balanced forces on the tail portions, with the bowed parts deforming equally as the tail is inserted into a via or hole.

Multiple of the contacts 112 or 162 may be maintained in a dielectric material, such as a molded thermoplastic, to maintain a desired spacing. For instance a series of the contacts 112 or 162 may be placed in a mold, with a suitable thermoplastic dielectric material molded in a header body or connector body around the contacts 112 or 162.

Figure 9:
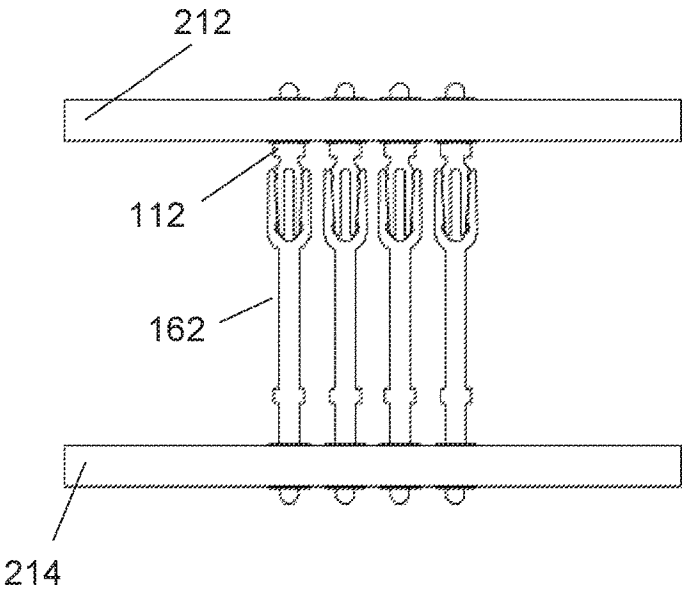
FIG. 9 is a side view of the board-to-board connection of FIG. 8, with connector bodies removed for illustration purposes.
Figure 8:
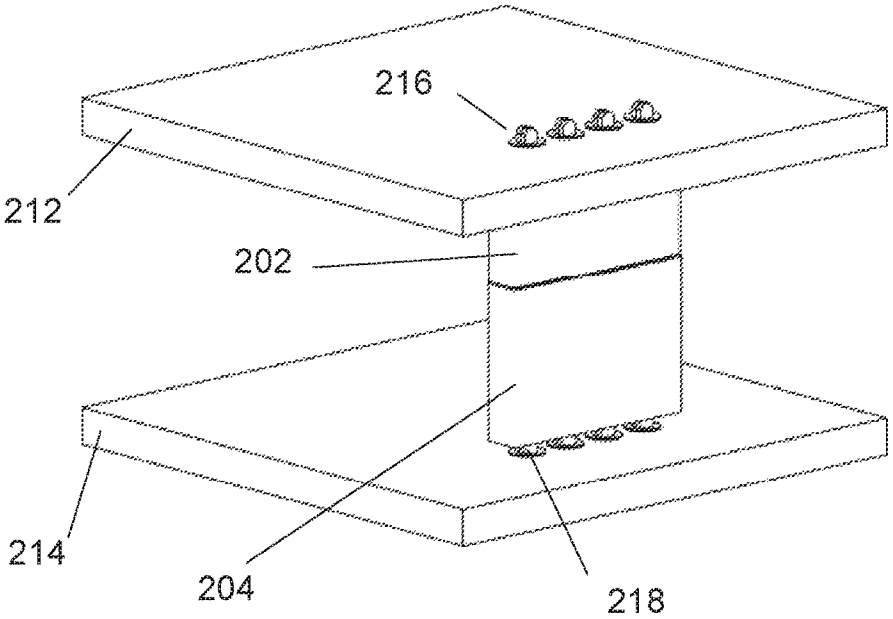
FIG. 8 is an oblique view of a board-to-board connection using an array of the contacts of FIGS. 6 and 7.

FIGS. 8 and 9 show engagement of connectors 202 and 204 to couple together a pair of stacked circuit boards 212 and 214 having respective series of vias 216 and 218. The connectors 202 and 204 include the respective series of contacts 112 and 162, with the connectors bodies of the connectors 202 and 204 removed in FIG. 9 for illustration purposes.

FIGS. 8 and 9 show a simple embodiment with only a single row of four contacts for each of the connectors 202 and 204. However there may be any of a wide variety for configurations of the contacts 112 and 162, with multiple rows of contacts in each of the connectors, to give one example.

In addition contacts having many of the features of the contacts described above may be used for other sorts of connections than the board-to-board connection shown in FIGS. 8 and 9.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An electrical contact pair comprising:

a male fork contact that includes a male fork base, and a pair of male fork tines emerging from the male fork base; and a female fork contact that includes a female fork base, and a pair of female fork tines emerging from the female fork base;

wherein the male fork tines have sloped outer surfaces sloping toward a centerline of the contact pair in a direction along the male fork tines away from the male fork base;

wherein the female fork tines have sloped inner surfaces sloping away from the centerline of the contact pair in a direction along the female fork tines away from the female fork base;

wherein the male fork tines and the female fork tines both deflect as the male fork tines are inserted into the female fork tines; and wherein the male fork contact and the female fork contact share a common plane.

2. The electrical contact pair of claim 1, wherein the sloped inner surfaces and the sloped outer surfaces have the same slope.

3. The electrical contact pair of claim 1, wherein the male fork contact and the female fork contact are sheet metal contacts.

4. The electrical contact pair of claim 1, wherein the deflections of the male fork times is the same as the deflections of the female fork tines, with the male fork and the female fork being equally loaded.

5. An electrical contact pair comprising:

a male fork contact that includes a male fork base, and a pair of male fork tines emerging from the male fork base; and a female fork contact that includes a female fork base, and a pair of female fork tines emerging from the female fork base;

wherein the male fork tines have sloped outer surfaces sloping toward a centerline of the contact pair in a direction along the male fork tines away from the male fork base;

wherein the female fork tines have sloped inner surfaces sloping away from the centerline of the contact pair in a direction along the female fork tines away from the female fork base;

wherein the male fork tines and the female fork tines both deflect as the male fork tines are inserted into the female fork tines; and wherein the male fork tines have respective outward protrusions, with curved outer surfaces, that protrude outward of the sloped outer surfaces, such that the outward protrusions make contact with the sloped inner surfaces of the female fork tines during engagement of the contacts.

6. The electrical contact pair of claim 5, wherein the outward protrusions are located at distal ends of the male fork tines, further from the male fork base than the sloped outer surfaces.

7. The electrical contact pair of claim 5, wherein the female fork tines define inward-facing receptacle recesses that receive the outward protrusions when the contacts are fully engaged.

8. The electrical contact pair of claim 7, wherein the inward-facing receptacle recesses have curved surfaces.

9. An electrical contact pair comprising:

a male fork contact that includes a male fork base, and a pair of male fork tines emerging from the male fork base; and a female fork contact that includes a female fork base, and a pair of female fork tines emerging from the female fork base;

wherein the male fork tines have sloped outer surfaces sloping toward a centerline of the contact pair in a direction along the male fork tines away from the male fork base;

wherein the female fork tines have sloped inner surfaces sloping away from the centerline of the contact pair in a direction along the female fork tines away from the female fork base;

wherein the male fork tines have respective outward protrusions, with curved outer surfaces, that protrude outward of the sloped outer surfaces, such that the outward protrusions make contact with the sloped inner surfaces of the female fork tines during engagement of the contacts;

wherein the female fork tines define inward-facing receptacle recesses that receive the outward protrusions when the contacts are fully engaged;

wherein the inward-facing receptacle recesses have curved surfaces; and wherein the curved surfaces of the inward-facing receptacle recesses have a radius of curvature that is smaller than a radius of curvature of the outward protrusions, such that when the contacts are engaged each of the outward protrusions makes contact at multiple contact points with a corresponding of the inward-facing receptacle recesses.

10. The electrical contact pair of claim 9, further comprising:

an additional male fork contact stacked with the male fork contact to form a stacked male fork contact, with the male fork contact and the additional male contact having an identical configuration of male fork tines; and an additional female fork contact stacked with the female fork contact to form a stacked female fork contact, with the female fork contact and the additional female contact having an identical configuration of female fork tines.

11. The electrical contact pair of claim 9, wherein the outward protrusions are located at distal ends of the male fork tines, further from the male fork base than the sloped outer surfaces.

12. The electrical contact pair of claim 9, wherein the female fork tines have respective inward protrusions, with curved inner surfaces, that protrude inward of the sloped inward surfaces, such that the inward protrusions make contact with the sloped outer surfaces of the male fork tines during engagement of the contacts.

13. The electrical contact pair of claim 12, wherein the male fork tines define outward-facing receptacle recesses that receive the inward protrusions when the contacts are fully engaged;

wherein the outward-facing receptacle recesses have curved surfaces; and wherein the curved surfaces of the outward-facing receptacle recesses have a radius of curvature that is smaller than a radius of curvature of the inward protrusions, such that when the contacts are engaged each of the inward protrusions makes contact at multiple contact points with a corresponding of the outward-facing receptacle recesses.

14. An electrical contact pair comprising:

a male fork contact that includes a male fork base, and a pair of male fork tines emerging from the male fork base; and a female fork contact that includes a female fork base, and a pair of female fork tines emerging from the female fork base;

wherein the male fork tines have sloped outer surfaces sloping toward a centerline of the contact pair in a direction along the male fork tines away from the male fork base;

wherein the female fork tines have sloped inner surfaces sloping away from the centerline of the contact pair in a direction along the female fork tines away from the female fork base;

wherein the male fork tines and the female fork tines both deflect as the male fork tines are inserted into the female fork tines; and wherein the female fork tines have respective inward protrusions, with curved inner surfaces, that protrude inward of the sloped inward surfaces, such that the inward protrusions make contact with the sloped outer surfaces of the male fork tines during engagement of the contacts.

15. The electrical contact pair of claim 14, wherein the male fork tines define outward-facing receptacle recesses that receive the inward protrusions when the contacts are fully engaged.

16. The electrical contact pair of claim 15, wherein the contacts are each symmetric about a plane of symmetry running through the centerline, between the male fork tines and the female fork tines.

17. The electrical contact pair of claim 15, wherein the outward-facing receptacle recesses have curved surfaces.

18. The electrical contact pair of claim 17, wherein the curved surfaces of the outward-facing receptacle recesses have a radius of curvature that is smaller than a radius of curvature of the inward protrusions, such that when the contacts are engaged each of the inward protrusions makes contact at multiple contact points with a corresponding of the outward-facing receptacle recesses.

19. An electrical contact pair comprising:

a male fork contact that includes a male fork base, and a pair of male fork tines emerging from the male fork base; and a female fork contact that includes a female fork base, and a pair of female fork tines emerging from the female fork base;

wherein the male fork tines have sloped outer surfaces sloping toward a centerline of the contact pair in a direction along the male fork tines away from the male fork base;

wherein the female fork tines have sloped inner surfaces sloping away from the centerline of the contact pair in a direction along the female fork tines away from the female fork base;

wherein the female fork tines have respective inward protrusions, with curved inner surfaces, that protrude inward of the sloped inward surfaces, such that the inward protrusions make contact with the sloped outer surfaces of the male fork tines during engagement of the contacts; and wherein the inward protrusions are located at distal ends of the female fork tines, further from the female fork base than the sloped inner surfaces.

20. An electrical contact pair comprising:

a male fork contact that includes a male fork base, and a pair of male fork tines emerging from the male fork base; and a female fork contact that includes a female fork base, and a pair of female fork tines emerging from the female fork base;

wherein the male fork tines have sloped outer surfaces sloping toward a centerline of the contact pair in a direction along the male fork tines away from the male fork base; and wherein the female fork tines have sloped inner surfaces sloping away from the centerline of the contact pair in a direction along the female fork tines away from the female fork base;

further comprising:

an additional male fork contact stacked with the male fork contact to form a stacked male fork contact, with the male fork contact and the additional male contact having an identical configuration of male fork tines; and an additional female fork contact stacked with the female fork contact to form a stacked female fork contact, with the female fork contact and the additional female contact having an identical configuration of female fork tines;

wherein one of the stacked contacts includes a tail which defines an eye between tail portions of the contacts of the one of the stacked contacts;

wherein the tail portions being on an opposite side of the one of the stacked contacts from the tines of the one of the stacked contacts;

wherein the eye being defined by at least one of the tail portions being bowed away from the other of the tail portions; and wherein the male fork contact and the female fork contact share a common plane.

21. The electrical contact pair of claim 20, wherein both of the tail portions bow away from each other to define the eye.

* * * * *